US007669280B2

(12) United States Patent
Rosenzweig

(10) Patent No.: US 7,669,280 B2
(45) Date of Patent: Mar. 2, 2010

(54) STEAM NOZZLE ATTACHMENT FOR USE WITH STEAM CLEANER

(75) Inventor: Maximilian Rosenzweig, Montreal (CA)

(73) Assignee: Euro-Pro Operating, LLC., Newton, MA (US)

( * ) Notice: Subject to any disclaimer, the term of this patent is extended or adjusted under 35 U.S.C. 154(b) by 1221 days.

(21) Appl. No.: 11/083,421

(22) Filed: Mar. 18, 2005

(65) Prior Publication Data

US 2006/0000049 A1 Jan. 5, 2006

Related U.S. Application Data

(63) Continuation-in-part of application No. 10/884,192, filed on Jul. 2, 2004, now Pat. No. 7,600,401.

(51) Int. Cl.
*A47L 9/06* (2006.01)

(52) U.S. Cl. ..... 15/322; 15/339; 15/393; 15/398; 15/403; 15/412; 15/320

(58) Field of Classification Search ..... 15/322, 15/393, 403, 398, 320, 339, 412; 68/222; 134/105
See application file for complete search history.

(56) References Cited

U.S. PATENT DOCUMENTS

| | | | | |
|---|---|---|---|---|
| 1,720,165 | A * | 7/1929 | Bloom et al. | 68/222 |
| 1,799,502 | A * | 4/1931 | Colburn | 68/222 |
| 2,053,282 | A | 9/1936 | Grewalt | |
| 4,073,030 | A * | 2/1978 | Albishausen | 15/322 |
| 4,074,387 | A * | 2/1978 | Arato et al. | 15/322 |
| 4,327,459 | A | 5/1982 | Gilbert | |
| 4,520,637 | A * | 6/1985 | Fleissner | 68/5 D |
| 4,584,736 | A * | 4/1986 | Gremminger | 15/322 |
| 4,905,712 | A | 3/1990 | Bowlin et al. | |
| 5,165,866 | A | 11/1992 | Kato | |
| 6,289,551 | B1 | 9/2001 | Basile | |
| 6,490,753 | B1 | 12/2002 | Chen | |
| 6,571,421 | B1 | 6/2003 | Sham et al. | |
| 7,380,307 | B2 | 6/2008 | Tsai | |
| 2002/0094285 | A1 | 7/2002 | Paolini et al. | |

(Continued)

FOREIGN PATENT DOCUMENTS

| | | |
|---|---|---|
| CH | 429 211 A | 1/1967 |

(Continued)

OTHER PUBLICATIONS

Euro-Pro Operating LLC; Steam Shark II Owner's Manual Model EP908EF; Nov. 2003; St. Laurent, Quebec H4S 1A7.

(Continued)

*Primary Examiner*—Joseph J Hail, III
*Assistant Examiner*—Robert Scruggs
(74) *Attorney, Agent, or Firm*—McCarter & English; Michael I. Wolfson

(57) ABSTRACT

A steam nozzle attachment for a steam cleaner having a substantially rectangular frame with a steam outlet positioned between the front and rear walls of the frame is provided. A plurality of baffles to distribute steam are disposed substantially perpendicular to the steam nozzle between the side walls of the frame. A replaceable fabric pocket that fits snugly over the frame is provided to distribute cleaning steam to the surface to be cleaned.

21 Claims, 7 Drawing Sheets

U.S. PATENT DOCUMENTS

| | | | |
|---|---|---|---|
| 2002/0106970 | A1 | 8/2002 | Falla |
| 2002/0112744 | A1 | 8/2002 | Besseling |
| 2003/0089383 | A1 | 5/2003 | Biggs |
| 2004/0134016 | A1 | 7/2004 | Kisela |
| 2006/0000049 | A1 | 1/2006 | Rosenzweig |
| 2007/0130719 | A1 | 6/2007 | Zhou |

FOREIGN PATENT DOCUMENTS

| | | | |
|---|---|---|---|
| CN | 1368032 | A | 9/2002 |
| CN | 2540155 | Y | 3/2003 |
| CN | 2568117 | Y | 8/2003 |
| DE | 24 31 102 | A1 | 1/1976 |
| DE | 91 10 171 | U1 | 3/1993 |
| DE | 298 22 052 | U1 | 2/1999 |
| DE | 299 10 658 | U1 | 9/1999 |
| DE | 200 01 462 | U1 | 1/2001 |
| DE | 100 15 941 | A1 | 10/2001 |
| DE | 102 05 507 | A1 | 8/2003 |
| DE | 20 2006 001189 | U1 | 4/2006 |
| EP | 1 027 855 | A2 | 8/2000 |
| EP | 1 224 899 | A2 | 7/2002 |
| EP | 1 554 968 | A | 7/2005 |
| FR | 601 312 | A | 2/1926 |
| FR | 709 689 | A | 8/1931 |
| FR | 2 282 252 | A | 3/1976 |
| FR | 2282252 | A | 3/1976 |
| GB | 1 449 483 | | 8/1973 |
| GB | 2 294 196 | A | 4/1996 |
| GB | 2 416 526 | A | 2/2006 |
| JP | 2001 327449 | A | 11/2001 |
| JP | 2004337454 | A | 12/2004 |
| WO | WO 98/23385 | A | 6/1998 |
| WO | WO 99/26522 | A | 6/1999 |
| WO | WO 02/43550 | A1 | 6/2002 |
| WO | WO 2007/065371 | A | 6/2007 |

OTHER PUBLICATIONS

Patent Abstracts of Japan, vol. 2002, No. 03, Apr. 3, 2002, Publication No. 2001327449 (Alpha Homes: KK), Nov. 21, 2001.

Euro-Pro Operating LLC; Portable Shark Steam Cleaner Owner's Manual Model SC505; Jan. 2003; p. 7; Champlain, NY 12919, pp. 1-11.

* cited by examiner

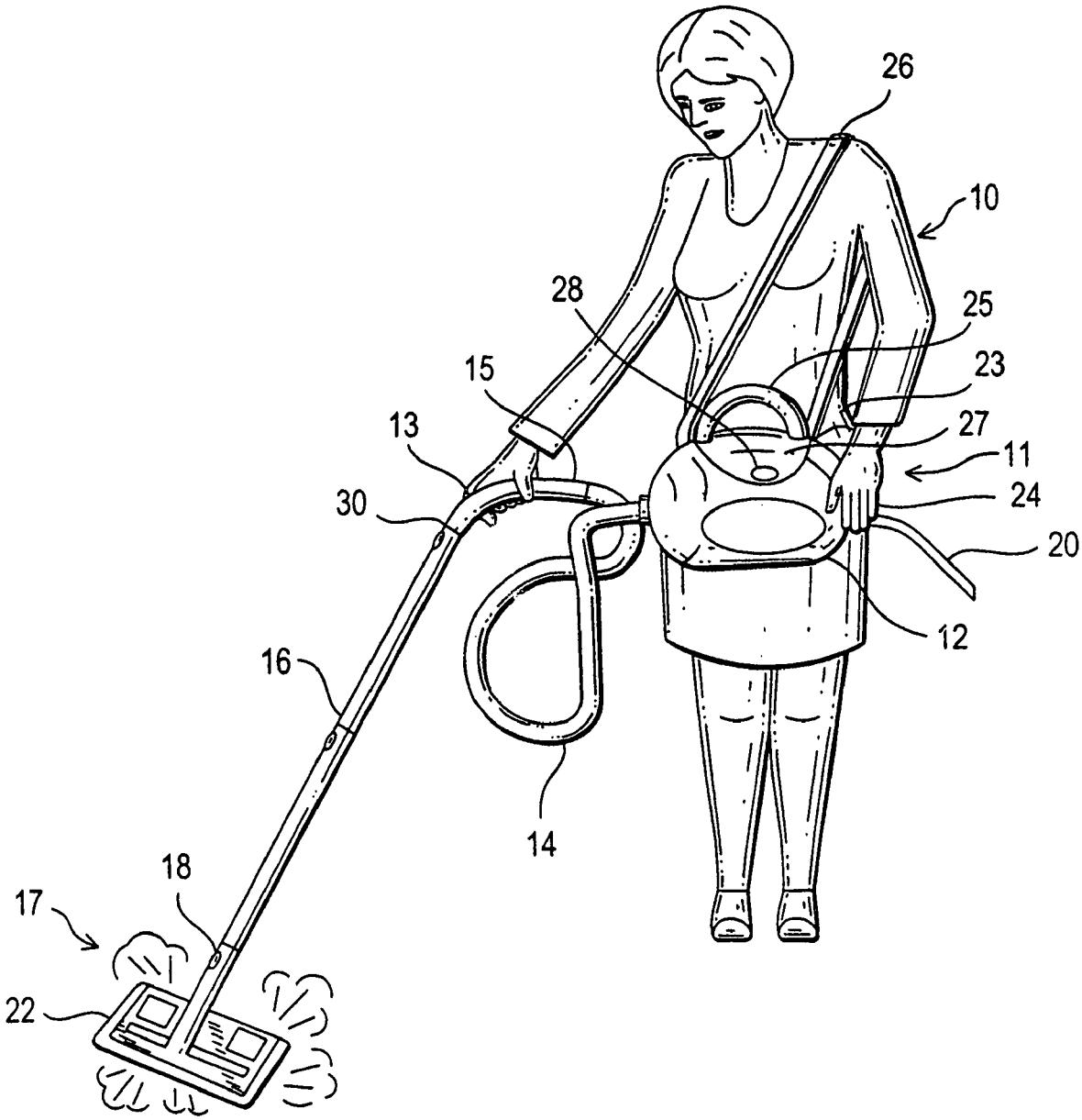
26
10
28
25
23
15
27
13
11
24
30
20
12
16
14
18
17
22

FIG. 4
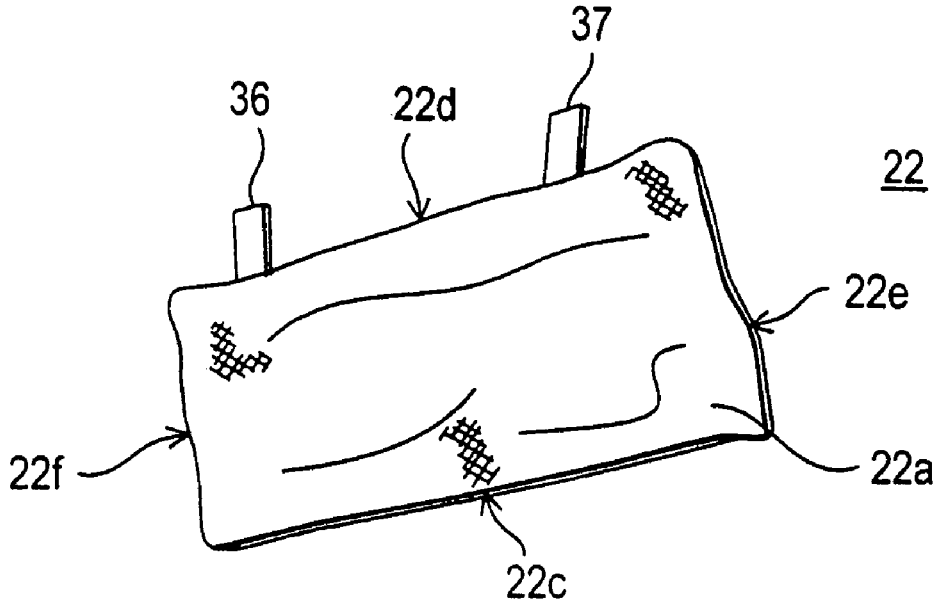
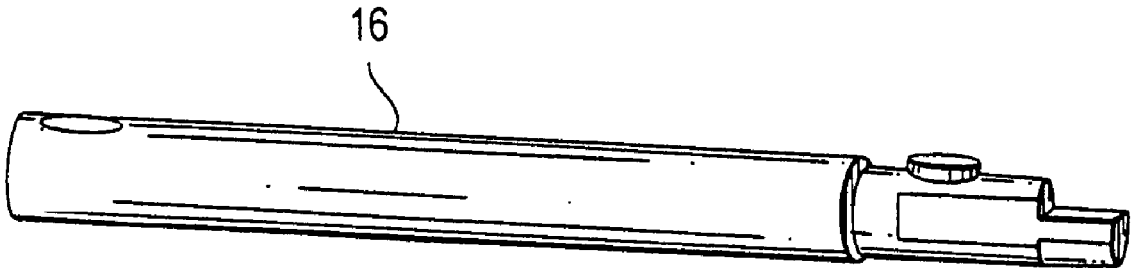
FIG. 5

STEAM NOZZLE ATTACHMENT FOR USE WITH STEAM CLEANER

CROSS-REFERENCE TO RELATED APPLICATIONS

This is a continuation-in-part of U.S. application Ser. No. 10/884,192, filed Jul. 2, 2004 now U.S. Pat. No. 7,600,401.

BACKGROUND OF THE INVENTION

The invention relates generally to a nozzle for use with a fabric steam pocket, and more particularly to a steam nozzle attachment with a fabric steam pocket cover for use with a steam cleaner.

Steaming devices used to apply steam to household objects are well known. The uses of the devices vary widely, and may include the application of steam to drapes or other fabrics to ease wrinkles, and the application of steam to objects to assist in cleaning the objects.

Typical steam devices have a reservoir for storing water with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, it is beneficial to provide suitable connectors between the steam generator and the nozzle to allow either the nozzle to be connected to the steam generator, or to allow the interpositioning of transfer tubes or hoses between the steam generator and the nozzle.

In general, the nozzles used with the steam cleaners do not have large surface areas and a cloth to absorb the liquid condensate of the steam. In order to increase the cleaning surface area, a flat fabric piece is folded around a flat brush or nozzle. The folded fabric on top of the brush or nozzle is secured by a clip on top of the piece. Often steam injected behind the cloth passes through the cloth at the points the bristles contact on the cloth. This tends to wet the cloth and reduce the cleaning effectiveness of the steam. In addition, the cloth covers must be carefully attached not to cover the front or back of the brush attachment.

Notwithstanding the wide variety of steam generating appliances available, there exists the need to provide an easy to install attachment for use with a steam cleaner. That will effectively improve the effective steaming surface area of the steam cleaners. It is desirable to provide this device with the ability for a user to clean a larger surface area easily without worrying about wiping up the liquid condensate of the steam when cleaning flooring, furniture and other household items.

SUMMARY OF THE INVENTION

Generally speaking, in accordance with the invention, a steam nozzle attachment to clean large surface areas with a steam cleaner is provided. The steam nozzle attachment includes a frame pivotally connected to a steamer pipe connected to a steam source. The frame is substantially rectangular in shape with baffles disposed substantially perpendicular to the steam nozzle on both upper and lower surfaces of the frame. The baffles are separated by a plane that is parallel to the nozzle. The steam nozzle also has a passageway perpendicular to the baffles that has openings to direct steam into the baffles and up the upper surface of the frame. In one embodiment, there are channels between the baffles so that the baffle on the upper surface and the lower surface of the frame are connected. A fabric steam pocket is two layers of fabric joined at three edges with fasteners at the open edge for fastening the pocket over the rear wall of the frame and is easily installed over the frame.

A steam nozzle is mounted to the lower surface of the attachment and is operatively connected to the steam cleaner outlet pipe. When steam is injected into the pocket, the entire surface area of the fabric may be used to steam clean a surface.

Accordingly, it is an object of the invention to provide a steam nozzle attachment to provide increased steam cleaning surface area.

Another object of the invention is to provide a fabric steam pocket that is easily mounted on an attachment for a steam cleaner.

A further object of the invention is to provide a steam nozzle attachment with a fabric cover that does not allow steam to escape at points of contact with brush bristles.

Yet another object of the invention is a fabric steam pocket that can be used for dual side cleaning.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which:

FIG. 1 is a perspective view of a user cleaning a floor with a portable steam cleaning device including a steam nozzle attachment with a fabric cover constructed and arranged in accordance with the invention;

FIG. 4 is a perspective view of a steam pocket fabric cover for use with the steam nozzle attachment of FIGS. 2A, 2B, 3A and 3B;

FIG. 5 is a perspective view of a rigid pipe suitable for use with the steam cleaner of FIG. 1;

DETAILED DESCRIPTION OF THE INVENTION

Figure 2A:
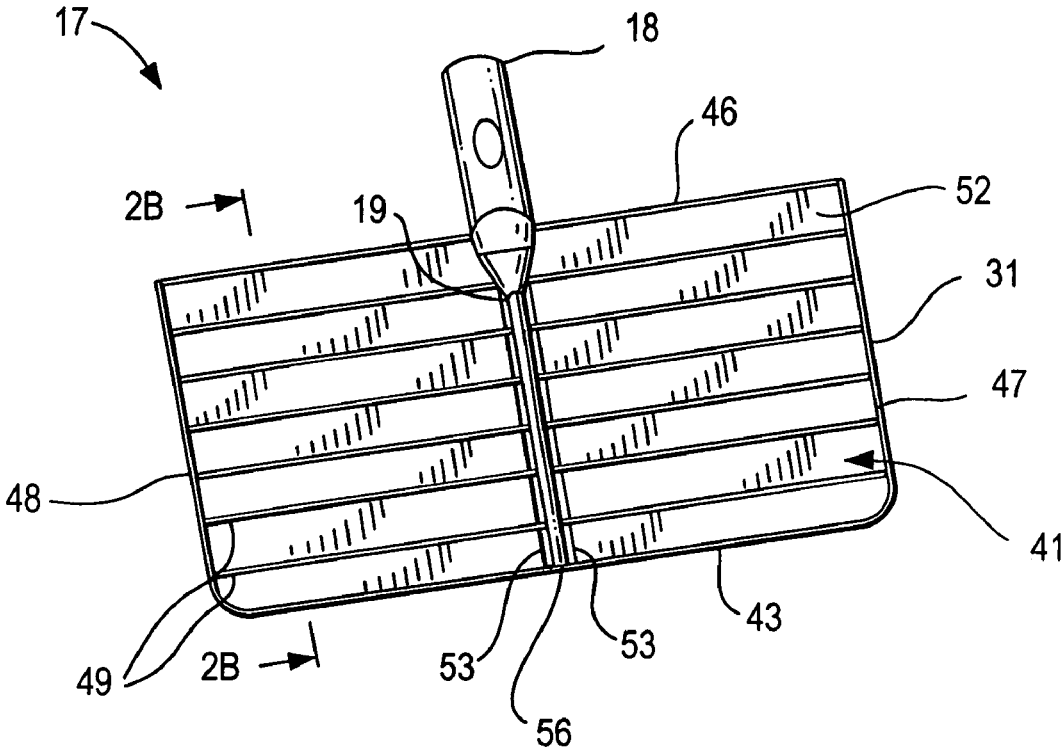
FIG. 2A is a top plan view of the steam nozzle attachment for use with a steam cleaner of the type shown in FIG. 1.

FIG. 1 is a perspective view of a user 10 using a steam cleaning device 11 including a main body 12 and a steam release hand grip 13 coupled to main body 12 by a flexible hose 14 and a steam outlet 15. A rigid pipe 16 is mounted on the distal nozzle end of hand grip 13. A steam nozzle attachment 17 constructed and arranged in accordance with the invention is mounted on the distal end of the rigid pipe 16. Steam nozzle attachment 17 is rectangular in shape and includes a pivotable hole steam inlet coupling or steam inlet 18 at the back edge or proximal end. A steam outlet 19 shown in FIG. 2A dispenses steam into a steam pocket fabric 22 which covers a steam pocket frame 31 on the front or distal side of steam nozzle attachment 17.

Steam inlet 18 has the same configuration as outlet 15 to rigid pipe 16. This allows for installation of the different attachments to steam release hand grip 13 of steam cleaner 11, such as brushes and nozzles.

Main body 12 of steam cleaning device 11 includes a water inlet 23 and an internal water reservoir 24 with heating elements connected to a power source by a power cord 20. Steam generated in reservoir 24 exits by steam outlet 15 through flexible hose 14 coupled thereto. Main body 12 is outfitted with a handle 25 and a strap 26 to allow user 10 to lift and carry main body 12. Conveniently, main body 12 also includes an on/off switch 27 and an indicator light 28 to indicate when steam temperature is appropriate for use.

Once water has been heated sufficiently to generate steam within main body 12, user 10 may selectively release steam by operation of hand grip 13. Hand grip 13 has a distal outlet end 30 for securing rigid pipe, or additional attachments, such as brushes or nozzles.

FIG. 2A is a top plan view of rectangular frame 31 of steam nozzle attachment 17. Rectangular frame 31 includes a front wall 43, a rear wall 46, a right side wall 47 and a left side wall 48. Frame 31 also includes an upper surface 41 and a lower surface 42 (shown in FIG. 2B). A plurality of baffles 49 extends from left side wall 48 to steam outlet 19 and from right side wall 47 to steam outlet 19 within frame 31. Baffles 49 are planar in shape and extend perpendicular to the sides of frame 31. Frame 31 has rear wall 46 with steam inlet 18 connected thereto. In this embodiment, baffles 49 on both upper surface 41 and lower surface 42 are separated from each other by a rectangular plane 52 that connects front wall 43, rear wall 46, right side wall 47 and left side wall 48 of frame 31 together. Steam outlet 19 has a passageway 56 that extends to front wall 43 perpendicular to baffles 49. Passageway 56 has a plurality of vents or openings 53 that surrounds passageway 56. Baffles 49 help direct the steam in the steam nozzle attachment 17 to upper surface 41 of frame 31. An advantage of steam nozzle attachment 17 is that steam rises out of upper surface of frame 31 to provide a dry surface with the benefits of steam when cleaning.

Figure 2B:
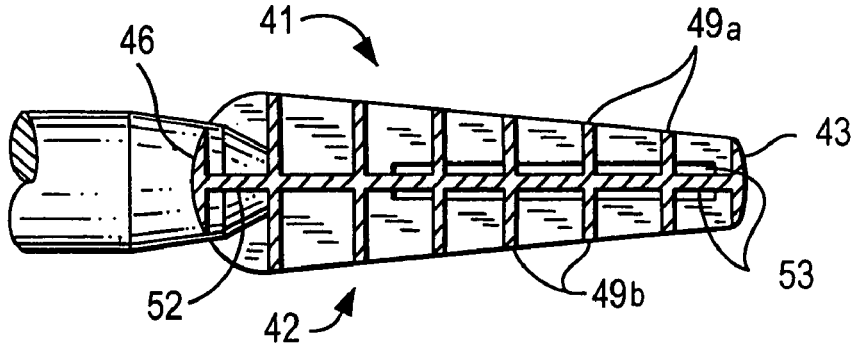
FIG. 2B is a cross-sectional view of the steam nozzle attachment of FIG. 2A taken along line 2B-2B.

FIG. 2B shows a cross-sectional view of steam nozzle attachment 17. Here, rectangular plane 52 is shown with baffles 49*a* on upper surface 41 and baffles 49*b* on lower surface 42. Passageway 56 (shown in FIG. 2A) has vents 53 on both upper surface 41 and lower surface 42 between each baffle to help direct steam into baffles 49*a* and 49*b*.

Figure 3A:
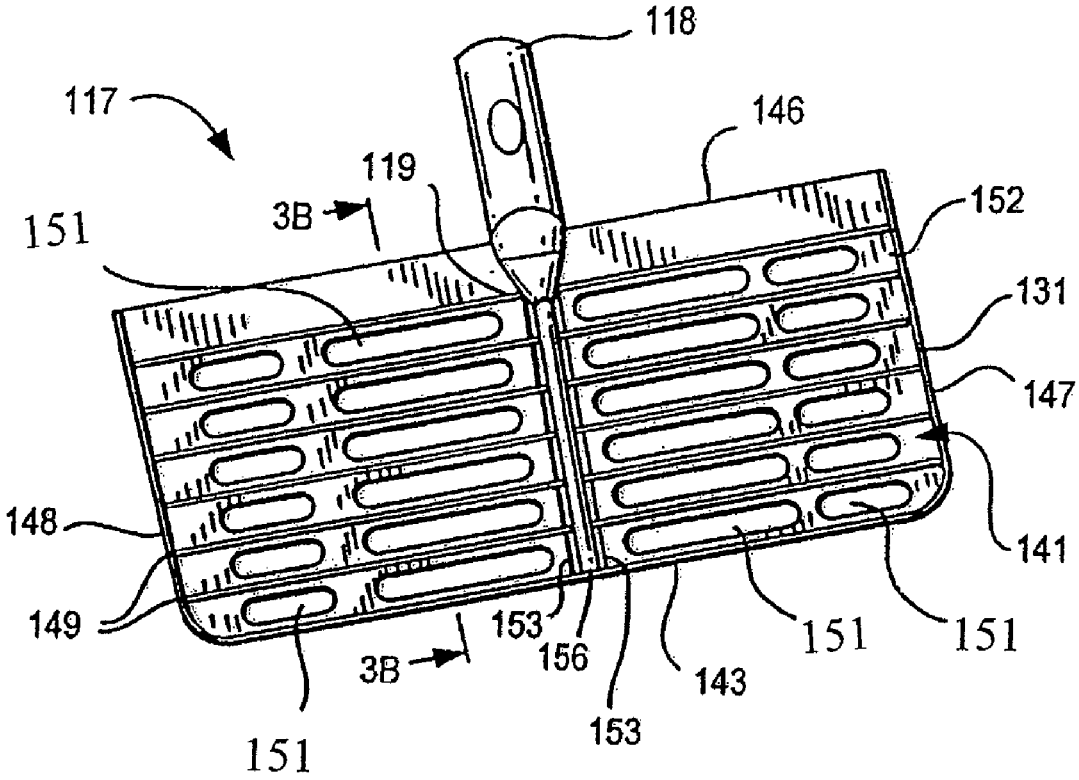
FIG. 3A is a top plan view of a steam nozzle attachment for use with a steam cleaner in accordance with another embodiment of the invention.

FIG. 3A is a top plan view of a steam nozzle attachment 117 for use with a steam cleaner, respectively, constructed and arranged in accordance with another embodiment of the invention. All elements in FIGS. 2A and 2B are present and identified by the same reference numerals plus 100. Here, a rectangular frame 131 includes a front wall 143, a rear wall 146, a right side wall 147 and a left side wall 148. Frame 131 also includes an upper surface 141 and a lower surface 142 (shown in FIG. 3B). A plurality of baffles 149 extends from left side wall 148 to steam outlet 119 and from right side wall 147 to steam outlet 119 within frame 131. Baffles 149 are substantially planar, with openings 151 in the plane 152 between baffles 149. Frame 131 has rear wall 146 with steam inlet 118 connected thereto. Baffles 149 on both upper surface 141 and lower surface 142 are separated from each other by a rectangular plane 152 that connects front wall 143, rear wall 146, right side wall 147 and left side wall 148 of frame 131 together. However, in this embodiment, there are channels 151 between baffles 149 so that baffles 149 on the upper surface 141 and baffles 149 on the lower surface 142 of frame 131 are connected.

Figure 3B:
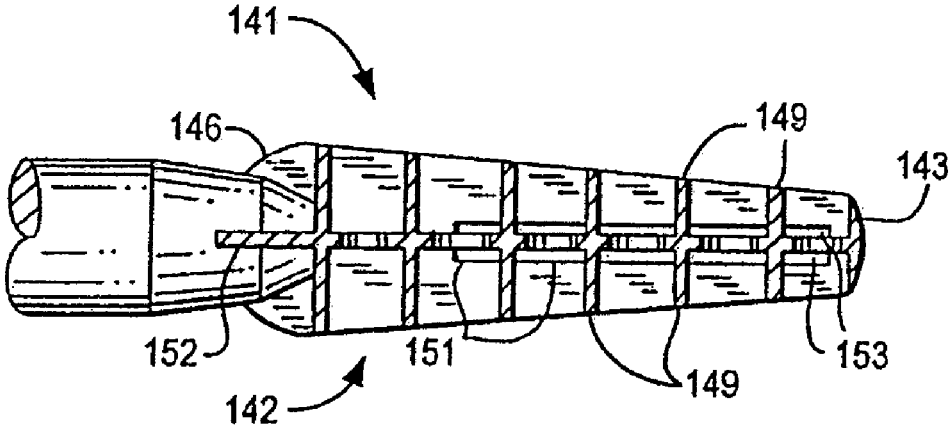
FIG. 3B is a cross-sectional view of steam nozzle attachment of FIG. 3A taken along line 3B-3B.

FIG. 3B shows a cross-sectional view of steam nozzle attachment 117. Here, rectangular frame 131 is shown with baffles 149 on both upper surface 141 and lower surface 142. As stated above, baffles 149 on the upper surface 141 and on the lower surface 142 of frame 131 have channels 151 between them are connected. Passageway 156 (shown in FIG. 3A) has vents or openings 153 on both upper surface 141 and lower surface 142 between each baffle to help direct steam into baffles 149.

Referring now to FIG. 4, the construction of steam pocket 22 for use with nozzles 17 and 117 is shown in detail. In the illustrated embodiment, steam pocket 22 is a cloth or towel. It may be formed of any suitable fabric such as cotton or a synthetic fabric, such as polyester or polyolefin fiber. Preferably, the fabric of pocket 22 is a microfiber. Most preferably, the microfiber is a synthetic polyester microfiber.

Steam pocket 22 is configured to slip over frame 31. In this respect, it is formed of a first layer 22*a* and an opposed second layer 22*b*, each having a rectangular shape with two opposed long edges 22*c* and 22*d* and two opposed short sides 22*e* and 22*f* as shown in FIG. 2*b*. Short edges 22*e* and 22*f* and one long side 22*c* are stitched to form pocket 22.

A pair of straps 36 and 37 is mounted on open side of the steam pocket 22. In the preferred embodiment, fasteners 36 and 37 are fabric hook-and-loop fasteners, such as VELCRO-type fasteners. Alternatively, straps 36 and 37 may include buttons or snaps. In each case, straps 36 and 37 are placed over steam pocket frame 31 or 131 and secured to hold pocket 22 in place when used to clean a floor or other surface as shown in FIGS. 6 and 7.

The rigid pipe suitable for use with the steam cleaner is shown in FIG. 5.

Figure 6:
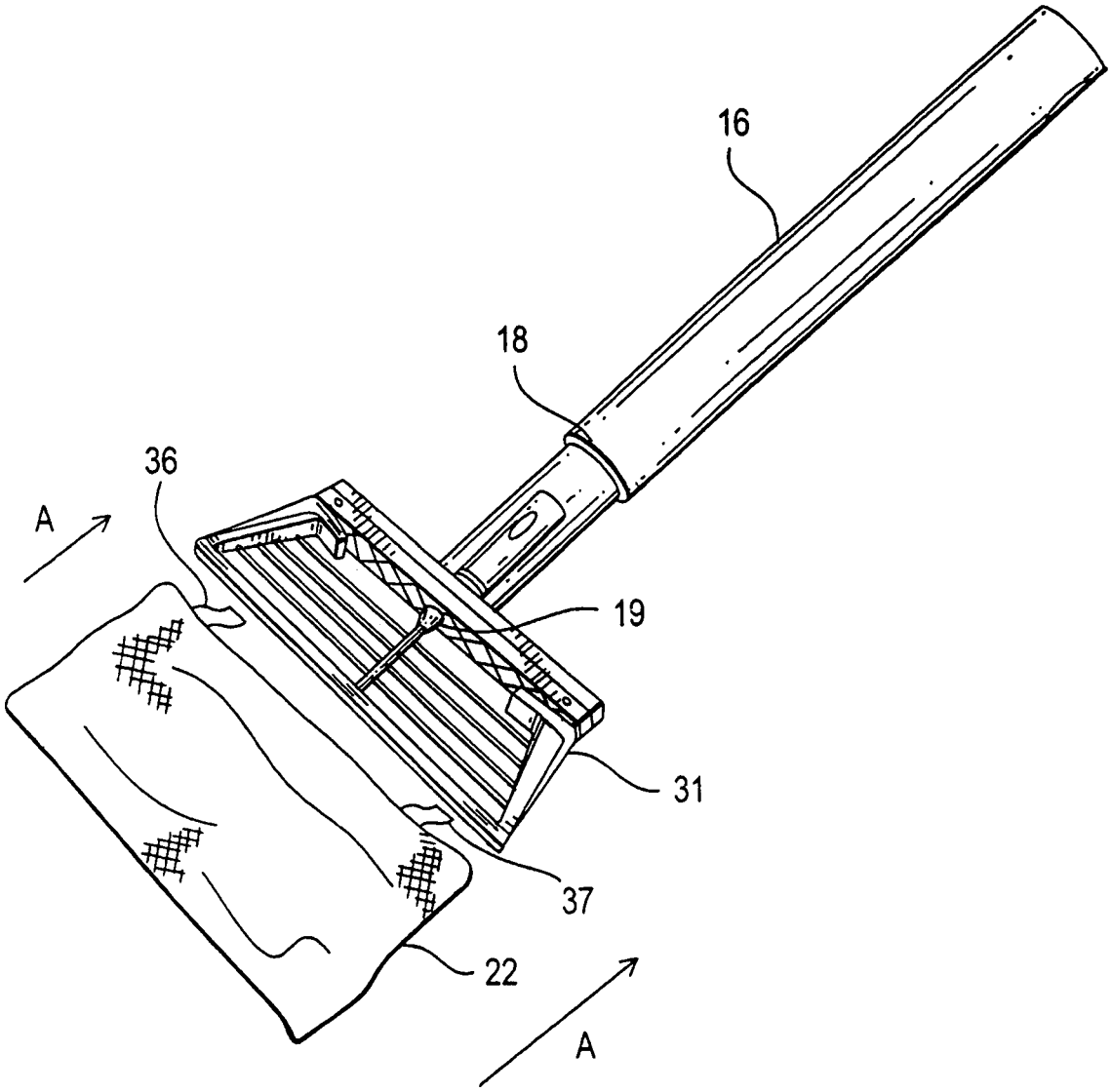
FIG. 6 is an exploded perspective view showing how a fabric steam pocket is mounted onto the attachment of FIG. 2.
Figure 7:
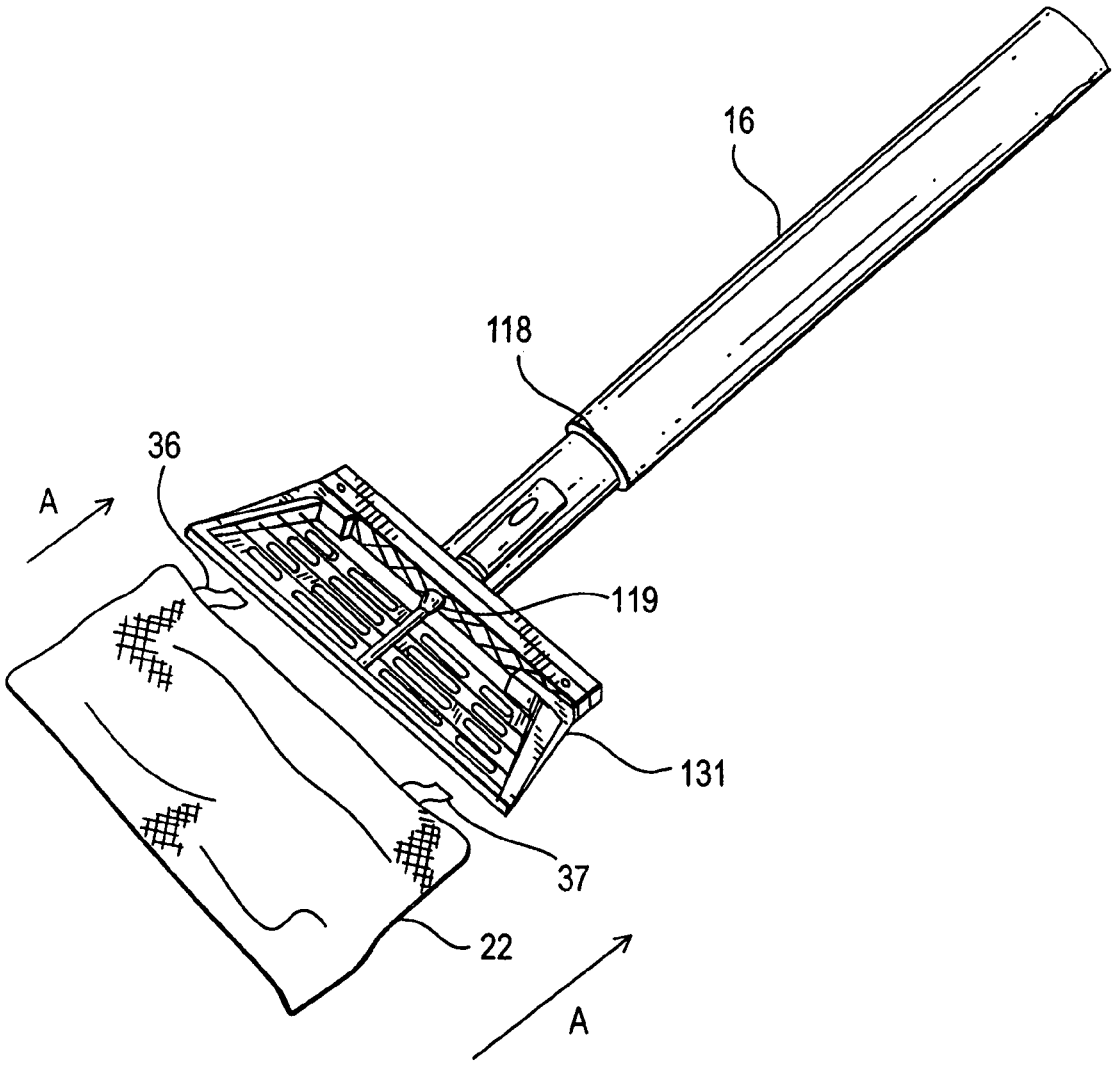
FIG. 7 is an exploded perspective view showing how a fabric steam pocket is mounted onto the attachment of FIG. 3.
Figure 8:
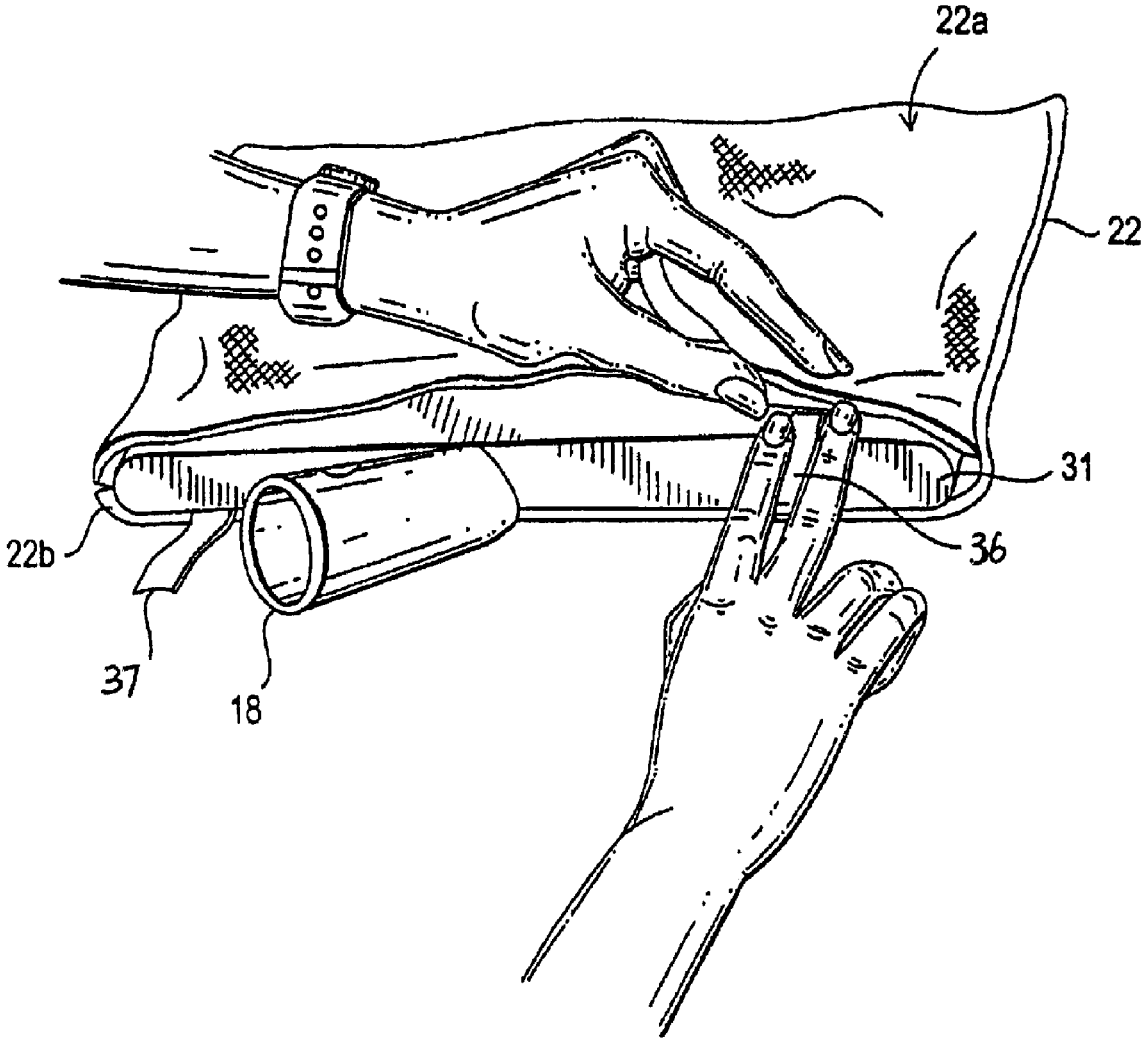
FIG. 8 is a perspective view of a steam pocket being attached to the steam nozzle attachment constructed and arranged in accordance with the invention.

FIGS. 6 and 7 show how a fabric steam pocket is mounted onto the attachment of FIGS. 2 and 3, respectively. FIG. 8 illustrates a fabric steam pocket mounted onto the steam nozzle attachment.

Inlet coupling 18 attached to steam nozzle attachment 17 may be rotated so user 10 may use both sides of steam pocket fabric 22 without having to reinstall steam pocket 22. This extends the time steam pocket 22 may be used without having to rinse and reinstall it.

A steam nozzle attachment 17 with a steamed pocket fabric cover 22 in accordance with the invention provides a vast improvement over placing a towel onto a bristle attachment for a steam cleaner. It avoids puncture of the cloth by the bristles and provides twice the cleaning surface. Moreover, the fabric cover is easily installed and replaced.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention. A steam nozzle attachment with a fabric pocket cover in accordance with the invention provides a vast improvement over placing a towel onto a bristle attachment for a steam cleaned. It avoids puncture of the cloth by the bristles and provide twice the cleaning surface. Moreover, the fabric cover is easily installed and replaced.

What is claimed is:

1. A steam nozzle attachment for mounting a fabric steam pocket for use with a steam cleaner, comprising:

a frame with a top side and a bottom side, comprising:

a front wall extending from the top side to the bottom side;

a rear wall extending from the top side to the bottom side, the rear wall with a steam inlet mounted to the outside of the rear wall and a steam nozzle mounted on the inside of the rear wall, the nozzle having a passageway that extends from the nozzle to a position substantially adjacent to the inside of the front wall;

a right side wall extending from the top side to the bottom side;

a left side wall extending from the top side to the bottom side;

a central plane having an upper surface and an opposed lower surface, the central plane extending between: (i) the front wall and the rear wall, and (ii) the right side wall and the left side wall;

a first plurality of baffles extending: (i) substantially vertically upwards from the upper surface of the central plane to the top side of the frame, (ii) from the left side wall to the nozzle, and (iii) from the right side wall to the nozzle;

a second plurality of baffles extending: (i) substantially vertically downwards from the lower surface of the central plane to the bottom side of the frame, (ii) from the left side wall to the nozzle, and (iii) from the right side wall to the nozzle;

a steam pipe for providing steam to the steam inlet; and the nozzle connected to a steam outlet for injecting steam into the region between the first and second plurality of baffles and onto a fabric steam pocket mounted on the frame.

2. The steam nozzle attachment of claim 1, wherein the frame is rotatable about the steam inlet so that the top side and the bottom side of the frame can be used for steam cleaning.

3. The steam nozzle attachment of claim 1, wherein the central plane of the frame has channels or openings connecting the first plurality of baffles on an the upper surface of the plane with the second plurality of baffles on the opposed lower surface of the plane.

4. The steam nozzle attachment of claim 1, wherein the passageway that extends to the inside of the front wall is substantially perpendicular to the first and second plurality of baffles.

5. The steam nozzle attachment of claim 1, wherein the passageway has vents to direct steam into the region between the first and second plurality of baffles.

6. A steam nozzle attachment and a fabric steam pocket assembly that releasably mounts a frame, the frame comprising:

a top side and a bottom side;

a front wall extending from the top side to the bottom side;

a rear wall extending from the top side to the bottom side, the rear wall with a steam inlet mounted to the outside of the rear wall and a steam nozzle mounted on the inside of the rear wall, the nozzle having a passageway that extends from the nozzle to a position substantially adjacent to the inside of the front wall;

a right side wall extending from the top side to the bottom side;

a left side wall extending from the top side to the bottom side;

a central plane having an upper surface and an opposed lower surface, the central plane extending between: (i) the front wall and the rear wall, and (ii) the right side wall and the left side wall;

a first plurality of baffles extending: (i) substantially vertically upwards from the upper surface of the central plane to the top side of the frame, (ii) from the left side wall to the nozzle, and (iii) from the right side wall to the nozzle;

a second plurality of baffles extending: (i) substantially vertically downwards from the lower surface of the central plane to the bottom side of the frame, (ii) from the left side wall to the nozzle, and (iii) from the right side wall to the nozzle;

a fabric steam pocket having two substantially planar surfaces with an opening therebetween positioned on the edges of the first and second plurality of baffles and frame; and the central plane of the frame has channels connecting the first plurality of baffles on the upper surface of the plane with the second plurality of baffles on the lower surface of the plane.

7. The steam nozzle attachment of claim 6, wherein the frame is rotatable about the steam inlet so that both surfaces of the steam pocket can be used for steam cleaning.

8. The steam nozzle attachment of claim 6, wherein the passageway that extends to the inside of the front wall is substantially perpendicular to the first and second plurality of baffles.

9. The steam nozzle attachment of claim 6, wherein the passageway has vents to direct steam into the region between the first and second plurality of baffles.

10. A steam pocket assembly for use with a steam cleaner, comprising:

a frame with a top side and a bottom side, comprising:

a front wall extending from the top side to the bottom side;

a rear wall extending from the top side to the bottom side, the rear wall with a steam inlet positioned on one side of the rear wall and a steam nozzle mounted to the opposed side of the rear wall, the nozzle having a passageway that extends from the nozzle to a position substantially adjacent to the inside of the front wall;

a right side wall extending from the top side to the bottom side;

a left side wall extending from the top side to the bottom side;

a plurality of baffles extending: (i) from the top side to the bottom side, the baffles extending substantially vertically relative to and between the top and bottom sides, (ii) from the left side wall to the nozzle, and (iii) from the right side wall to the nozzle;

a fabric steam pocket configured and dimensioned to be secured to the frame, the fabric steam pocket including: (i) a first substantially planar layer of fabric and a corresponding second layer of fabric with the first and second layer joined about a portion of the perimeter to provide an open side to allow for securing on the rear wall of the frame, and (ii) at least two fasteners secured to the first layer along the open side fasteners to be secured to the second layer of fabric for securing the fabric steam pocket to the frame.

11. The steam pocket assembly of claim 10, wherein the steam nozzle is configured and dimensioned to distribute steam into the region between the baffles and onto the fabric steam pocket secured on the frame.

12. The steam pocket assembly of claim 10, wherein the frame is rotatable about the steam inlet so that the top side and the bottom side of the frame can be used for steam cleaning.

13. The steam pocket assembly of claim 10, wherein the passageway that extends to the inside of the front wall is substantially perpendicular to the baffles.

14. The steam pocket assembly of claim 10, wherein the passageway has vents to direct steam into the region between the baffles.

15. The steam pocket assembly of claim 10, wherein each baffle of the plurality of baffles is non-perforated.

16. The steam pocket assembly of claim 10, wherein as the fasteners are straps fixedly attached to one fabric layer and adjusted to be wrapped around the rear wall of the frame to be releasably secured to the other fabric layer.

17. A steam pocket assembly for use with a steam cleaner, comprising:

a frame with a top side and a bottom side, comprising:

a front wall extending from the top side to the bottom side;

a rear wall extending from the top side to the bottom side, the rear wall with a steam inlet positioned on one side of the rear wall and a steam nozzle mounted to the opposed side of the rear wall, the nozzle having a passageway that extends from the nozzle to a position substantially adjacent to the inside of the front wall;

a right side wall extending from the top side to the bottom side;

a left side wall extending from the top side to the bottom side;

a plurality of baffles extending: (i) from the top side to the bottom side, the baffles extending substantially vertically relative to and between the top and bottom sides and (ii) crossing the passageway substantially at right angles;

a fabric steam pocket configured and dimensioned to be secured to the frame, the fabric steam pocket including: (i) a first substantially planar layer of fabric and a corresponding second layer of fabric with the first and second layer joined about a portion of the perimeter to provide an open side to allow for securing on the rear wall of the frame, and (ii) at least two fasteners secured to the first layer along the open side fasteners to be secured to the second layer of fabric for securing the fabric steam pocket to the frame.

18. The steam pocket assembly of claim 17, wherein the steam nozzle is configured and dimensioned to distribute steam into the region between the baffles and onto the fabric steam pocket secured on the frame.

19. The steam pocket assembly of claim 17, wherein the frame is rotatable about the steam inlet so that the top side and the bottom side of the frame can be used for steam cleaning.

20. The steam pocket assembly of claim 17, wherein the passageway has vents to direct steam into the region between the baffles.

21. The steam pocket assembly of claim 17, wherein as the fasteners are straps fixedly attached to one fabric layer and adjusted to be wrapped around the rear wall of the frame to be releasably secured to the other fabric layer.

* * * * *